US011533795B2

(12) United States Patent
Zheng et al.

(10) Patent No.: US 11,533,795 B2
(45) Date of Patent: Dec. 20, 2022

(54) TRIAC SINGLE-FIRE-WIRE POWER-TAKING INFRARED SMART DIMMER

(71) Applicant: Zhuhai Shengchang Electronics Co., Ltd., Zhuhai (CN)

(72) Inventors: Dehua Zheng, Zhuhai (CN); Xidi Xie, Jieyang (CN)

(73) Assignee: Zhuhai Shengchang Electronics Co., Ltd., Zhuhai (CN)

( * ) Notice: Subject to any disclaimer, the term of this patent is extended or adjusted under 35 U.S.C. 154(b) by 0 days.

(21) Appl. No.: 17/560,104

(22) Filed: Dec. 22, 2021

(65) Prior Publication Data

US 2022/0330397 A1 Oct. 13, 2022

(30) Foreign Application Priority Data

Apr. 7, 2021 (CN) ..... 202110370766.9
Apr. 7, 2021 (CN) ..... 202120698928.7

(51) Int. Cl.
*H05B 45/10* (2020.01)
*H05B 45/3725* (2020.01)

(52) U.S. Cl.
CPC ..... *H05B 45/10* (2020.01); *H05B 45/3725* (2020.01)

(58) Field of Classification Search
CPC ..... H05B 45/10; H05B 45/3725
See application file for complete search history.

(56) References Cited

U.S. PATENT DOCUMENTS 10,716,179 B1 * 7/2020 Wang ..... H05B 45/37

* cited by examiner

*Primary Examiner* — Minh D A
(74) *Attorney, Agent, or Firm* — Georgi Korobanov

(57) ABSTRACT

A TRIAC single-fire-wire power-taking infrared smart dimmer includes a single-fire-wire input device, a bridge rectifier, a LDO power circuit, a zero-crossing detector, a phase cut dimmer, an overpower protector, an input device, a single-fire-wire output device, an infrared receiver circuit, a brightness indicator circuit, a minimum brightness setting device, a leading edge phase cut/trailing edge phase cut selecting device, and a single chip microcomputer minimum system. The infrared receiver circuit receives external data or data inputted by the input device to perform a smart control which can automatically distinguish and adapt an alternating current of 50 HZ or 60 HZ, select a leading edge phase cut dimmer or a trailing edge phase cut dimmer by an external module, and set a minimum brightness value. An indicator light is provided to display the current brightness percentage.

2 Claims, 14 Drawing Sheets

TRIAC SINGLE-FIRE-WIRE POWER-TAKING INFRARED SMART DIMMER

FIELD OF THE INVENTION

The present invention relates to the field of a single-fire-wire power taking, and more particularly to the technology of using an alternating current (AC) leading/trailing edge smart phase cut and infrared to control TRIAC (TRIode AC semiconductor switch) dimming and a TRIAC single-fire-wire power-taking infrared smart dimmer whose power supply is maintained by single-fire-wire power-taking, and the dimmer can select a leading edge phase cut or a trailing edge phase cut to fit the compatibility of various different dimming power supplies and infrared controlled MOSFET or IGBT tubes to replace the TRIAC dimming.

BACKGROUND OF THE INVENTION

At present, most traditional mechanical wall switch boxes only have a fire wire and no zero wire. With the development of the LED lighting technology, a novel smart dimmer is required to achieve the smart control of home lighting or commercial lighting and directly replace the old mechanical wall switch without requiring re-wiring, and the novel smart dimmer adopts a single-fire-wire for power-taking.

Using a TRIode AC semiconductor switch (TRIAC) to obtain and control power has the disadvantages of large amount of generated heat, low power taking efficiency, limited use by leading edge phase cut dimmers only, and poor compatibility for dimmable lamps. On the other hand, MOSFET or IGBT tubes have a higher power taking efficiency and a smaller amount of generated heat than those of the TRIAC, and can adapt the leading edge phase cut or trailing edge phase cut control and provide a better compatibility to various dimmable lamps.

Most dimmers are dimmers that can only perform a phase cut for the alternating current of 50 HZ or 60 HZ individually without the self-adjusting function to match with the alternating current 50 HZ or 60 HZ. Most single-fire-wire dimmers adopt a rotary potentiometer or a general switch, and thus they cannot have the smart dimming function.

In summation, most TRIAC dimming products on the market cannot directly achieve the single-fire-wire power-taking and wireless control dimming functions. Therefore, this invention provides a TRIAC single-fire-wire power-taking infrared smart dimmer capable of setting a leading edge phase cut or a trailing edge phase cut, using MOSFET or IGBT tubes to replace the TRIAC to perform the phase cut, supporting an infrared smart control, automatically distinguishing an alternating current of 50 HZ or 60 HZ for a smart control, displaying the current brightness percentage, and setting a minimum brightness.

SUMMARY OF THE INVENTION

It is a primary objective of the invention to overcome the deficiencies of the prior art by providing a TRIAC single-fire-wire power-taking infrared smart dimmer in accordance with the present invention.

To achieve the aforementioned and other objectives, the present invention discloses a TRIAC single-fire-wire power-taking infrared smart dimmer, including: a single-fire-wire input device, a bridge rectifier, a LDO power circuit, a zero-crossing detector, a phase cut dimmer, an overpower protector, an input device, a single-fire-wire output device, an infrared receiver circuit, a brightness indicator circuit, a minimum brightness setting device, a leading edge phase cut/trailing edge phase cut selecting device, and a single chip microcomputer minimum system, wherein the single-fire-wire input device is connected to the bridge rectifier; the bridge rectifier is connected to the LDO power circuit, the zero-crossing detector, and the phase cut dimmer; the LDO power circuit is connected to the overpower protector, the input device, the infrared receiver circuit, the brightness indicator circuit, the minimum brightness setting device, the leading edge phase cut/trailing edge phase cut selecting device, and the single chip microcomputer minimum system; the phase cut dimmer is connected to the single-fire-wire output device, and the single chip microcomputer minimum system is connected to the zero-crossing detector, the phase cut dimmer, the overpower protector, the input device, the infrared receiver circuit, the brightness indicator circuit, the minimum brightness setting device, and the leading edge phase cut/trailing edge phase cut selecting device.

Both of the single-fire-wire input device and the single-fire-wire output device are applicable to the alternating current of 50 HZ or 60 HZ. The bridge rectifier includes a rectifier pile or a diode capable of converting the alternating current of 50 HZ or 60 HZ from a sine wave into a square wave. The LDO power circuit includes an integrated low-dropout (LDO) chip or a discrete component to implement a LDO function. The zero-crossing detector includes a high/low level or analog-to-digital conversion (ADC) detector. The phase cut dimmer includes a MOS or an IGBT. The overpower protector includes a high/low level or ADC detector. The input device includes a button module or a touch module. The leading edge phase cut/trailing edge phase cut selecting device includes a DIP switch or a potentiometer. The minimum brightness setting device includes a rotary switch dial or a potentiometer. The brightness indicator circuit includes a light emitting diode. The infrared receiver circuit includes an infrared receiver module or a discrete circuit composed of the infrared receiver module. The single chip microcomputer minimum system detects the input device or the infrared receiver to perform a phase cut dimming.

This invention has the following advantageous effects: Since this invention includes the single-fire-wire input device, the bridge rectifier, the LDO power circuit, the zero-crossing detector, the phase cut dimmer, the overpower protector, the input device, the single-fire-wire output device, the infrared receiver circuit, the brightness indicator circuit, the minimum brightness setting device, the leading edge phase cut/trailing edge phase cut selecting device, and the single chip microcomputer minimum system, therefore this invention can use the infrared receiver circuit to receive external data or the data inputted by the input device to perform a smart control and can also automatically distinguish and adapt the alternating current of 50 HZ or 60 HZ, use an external module to select a leading edge phase cut dimming or a trailing edge phase cut dimming, set a minimum brightness value, and display the current brightness percentage by an indicator light.

DESCRIPTION OF THE PREFERRED EMBODIMENTS

Figure 1:
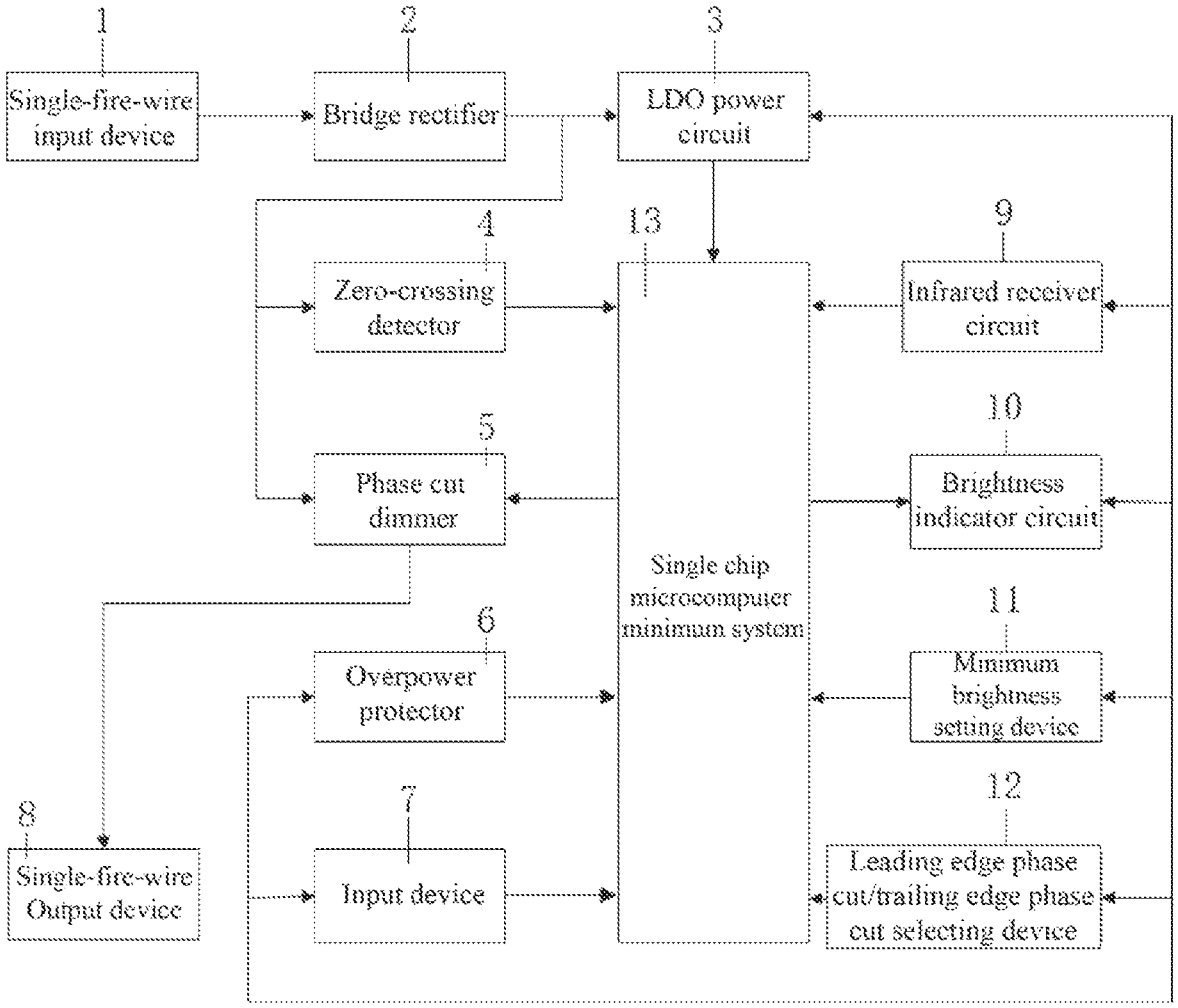
FIG. 1 is a schematic circuit block diagram of this invention.
Figure 2:
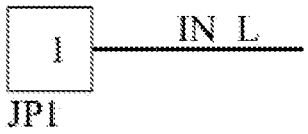
FIG. 2 is a schematic circuit diagram of a single-fire-wire input device of this invention.
Figure 3:
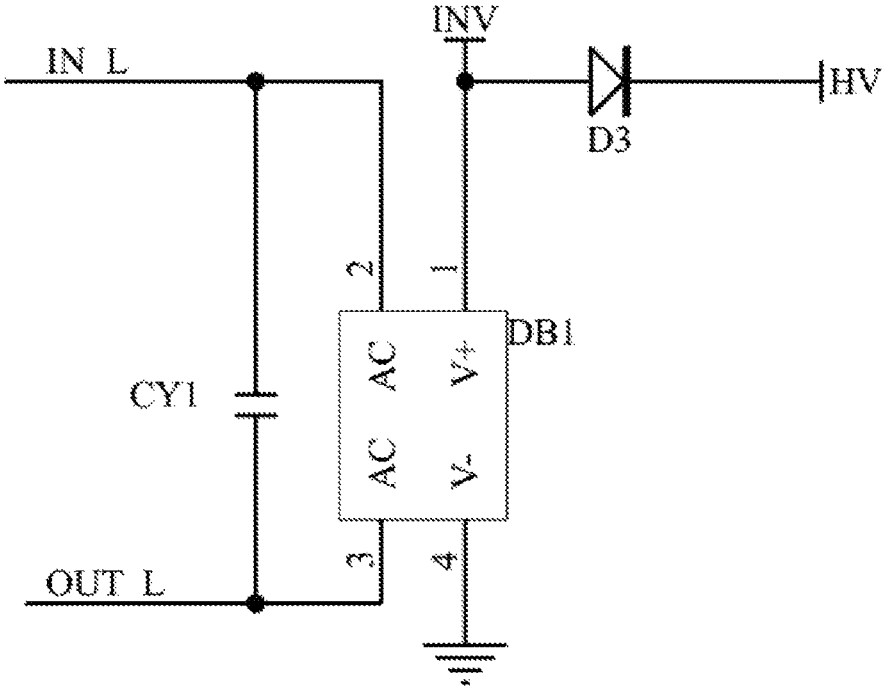
FIG. 3 is a schematic circuit diagram of a bridge rectifier of this invention.
Figure 4:
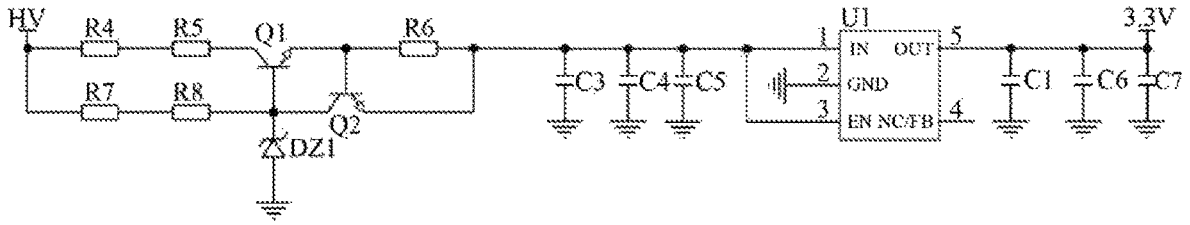
FIG. 4 is a schematic circuit diagram of a LDO power circuit of this invention.
Figure 5:
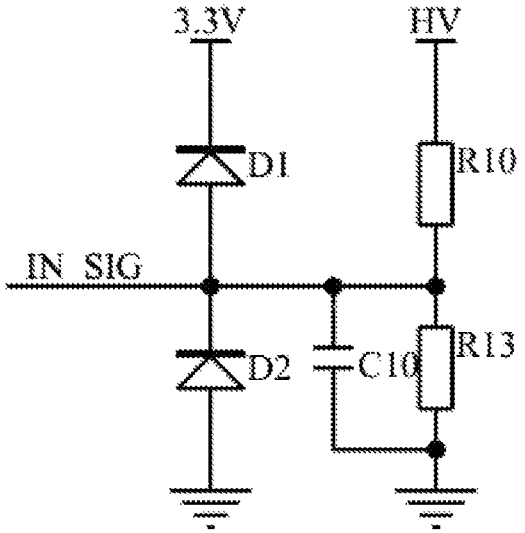
FIG. 5 is a schematic circuit diagram of a zero-crossing detector of this invention.
Figure 6:
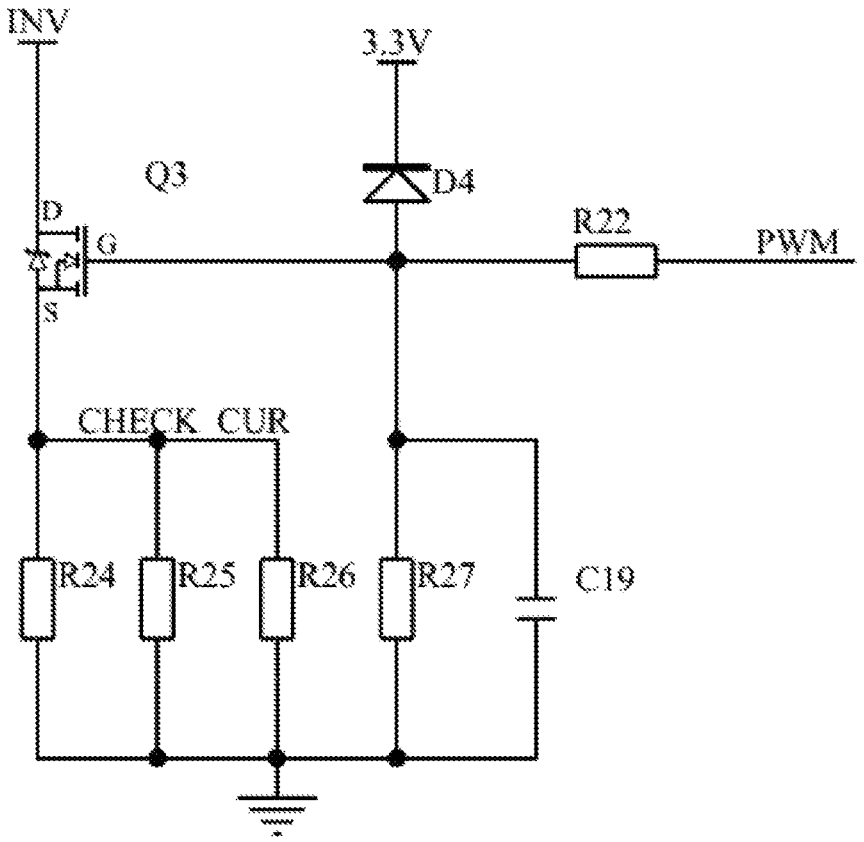
FIG. 6 is a schematic circuit diagram of a phase cut dimmer of this invention.
Figure 7:
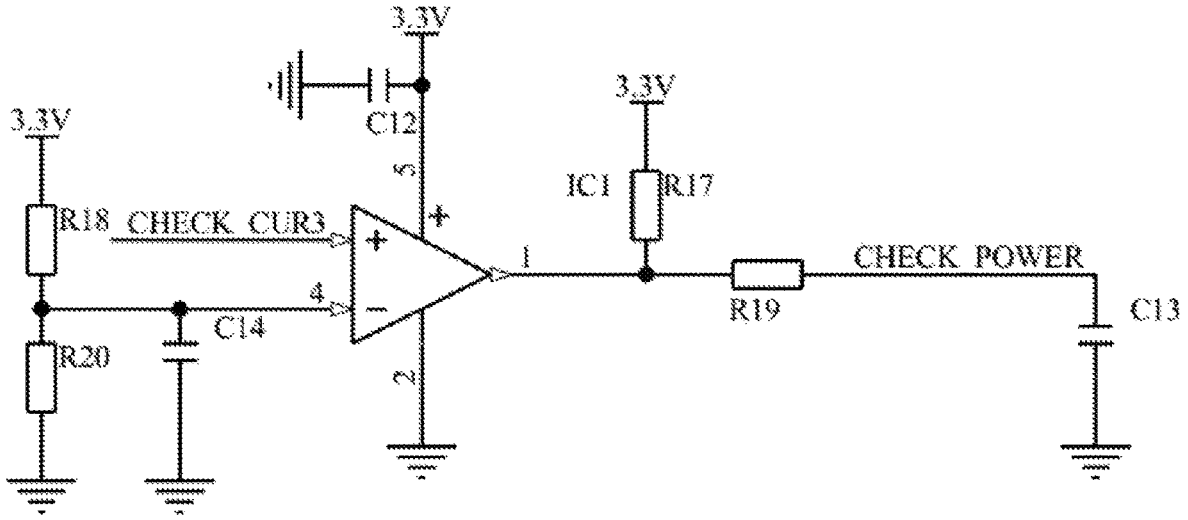
FIG. 7 is a schematic circuit diagram of an overpower protector of this invention.
Figure 8:
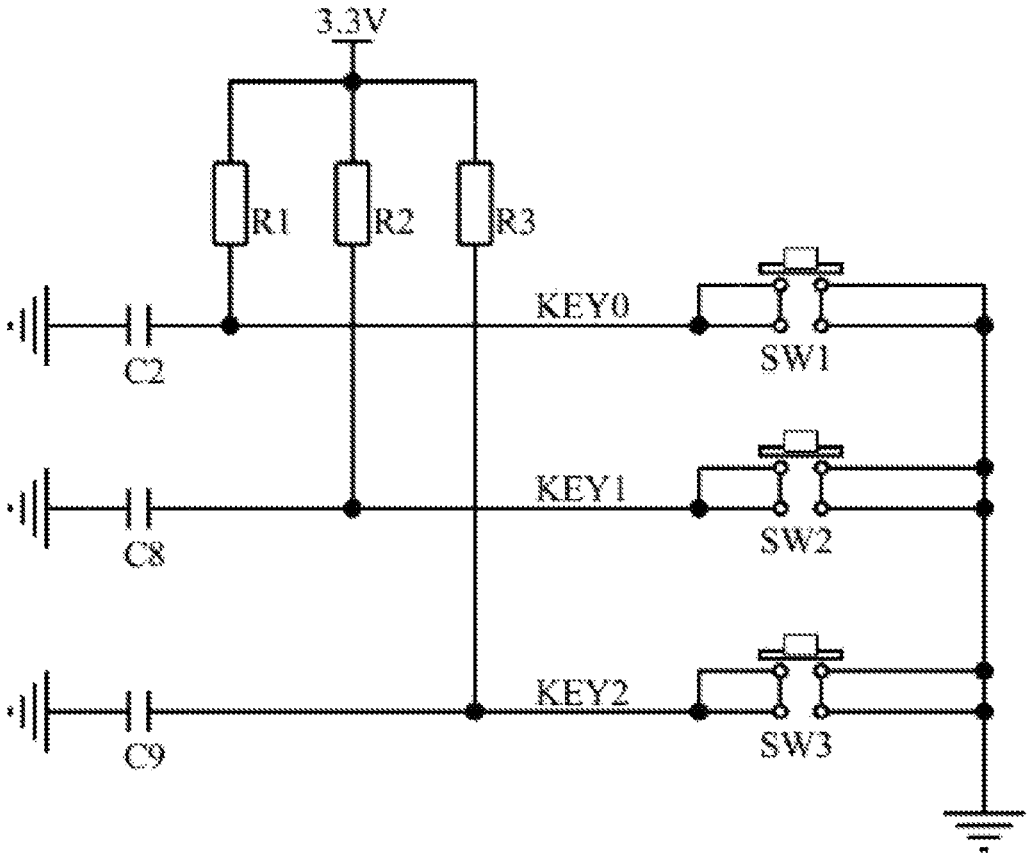
FIG. 8 is a schematic circuit diagram of an input device of this invention.
Figure 9:
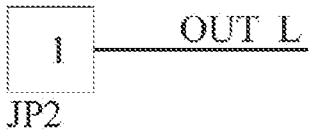
FIG. 9 is a schematic circuit diagram of a single-fire-wire output device of this invention.
Figure 10:
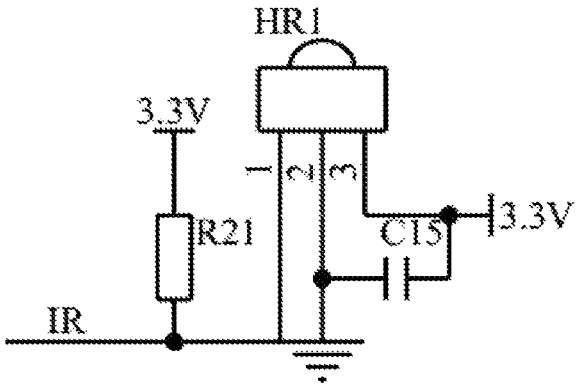
FIG. 10 is a schematic circuit diagram of an infrared receiver circuit of this invention.
Figure 11:
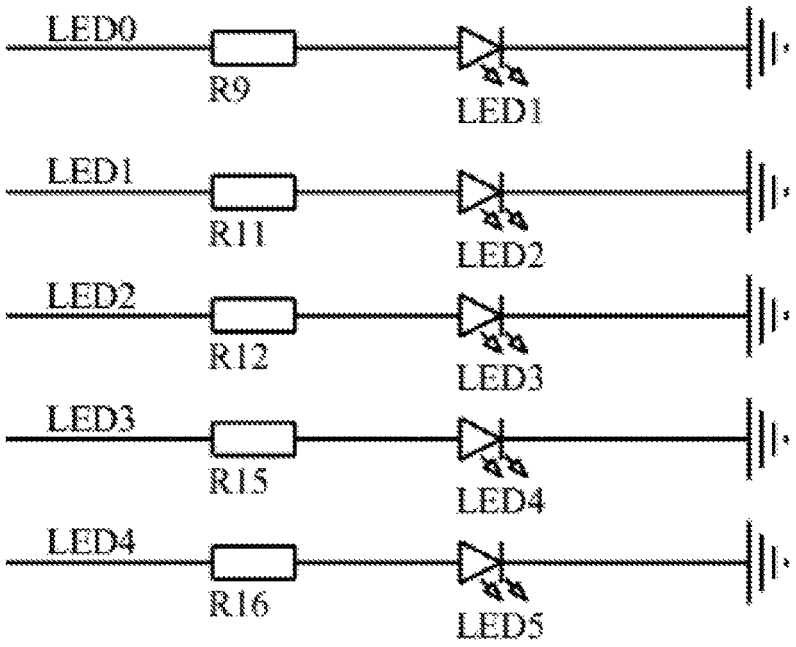
FIG. 11 is a schematic circuit diagram of a brightness indicator circuit of this invention.
Figure 12:
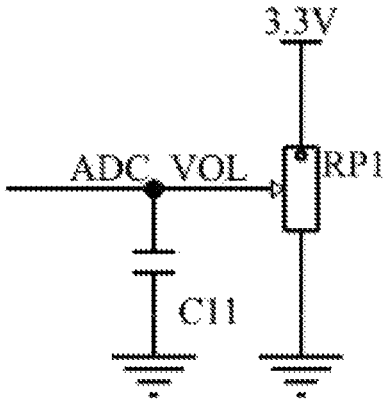
FIG. 12 is a schematic circuit diagram of a minimum brightness configuration circuit of this invention.
Figure 13:
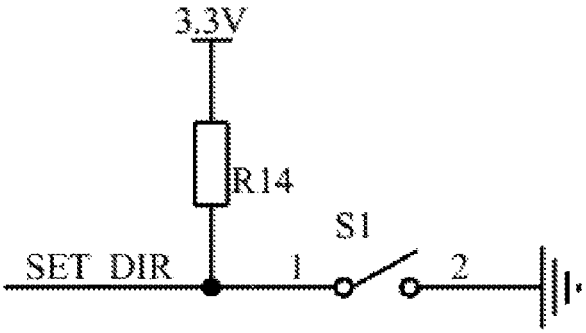
FIG. 13 is a schematic circuit diagram of a leading edge phase cut/trailing edge phase cut selecting device of this invention.
Figure 14:
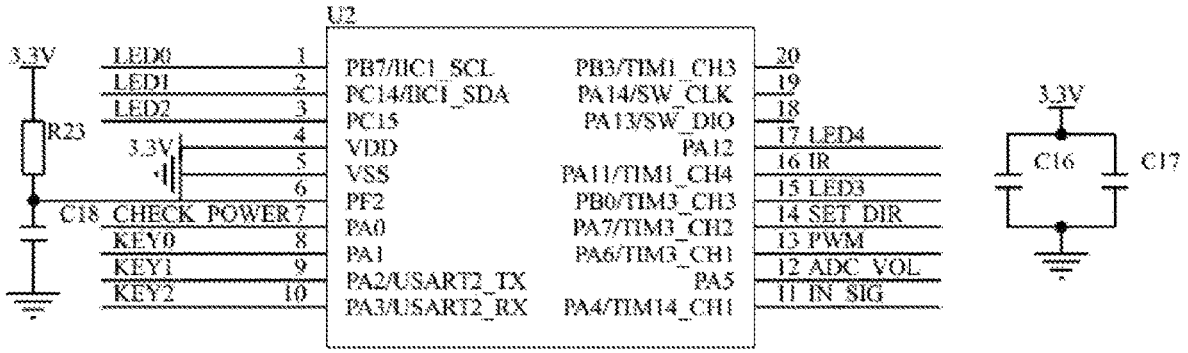
FIG. 14 is a schematic circuit diagram of a single chip microcomputer minimum system of this invention.

This invention will become clearer in light of the following detailed description of an illustrative embodiment of this invention described in connection with the drawings.

With reference to FIGS. 1 to 14 for a TRIAC single-fire-wire power-taking infrared smart dimmer in accordance with the present invention, the TRIAC single-fire-wire power-taking infrared smart dimmer includes a single-fire-wire input device 1, a bridge rectifier 2, a LDO power circuit 3, a zero-crossing detector 4, a phase cut dimmer 5, an overpower protector 6, an input device 7, a single-fire-wire output device 8, an infrared receiver circuit 9, a brightness indicator circuit 10, a minimum brightness setting device 11, a leading edge phase cut/trailing edge phase cut selecting device 12, and a single chip microcomputer minimum system 13. The single-fire-wire input device 1 is connected to the bridge rectifier 2; the bridge rectifier 2 is connected to the LDO power circuit 3, the zero-crossing detector 4, and the phase cut dimmer 5; the LDO power circuit 3 is connected to the overpower protector 6, the input device 7, the infrared receiver circuit 9, the brightness indicator circuit 10, the minimum brightness setting device 11, the leading edge phase cut/trailing edge phase cut selecting device 12, and the single chip microcomputer minimum system 13; the phase cut dimmer 5 is connected to the single-fire-wire output device 8; and the single chip microcomputer minimum system 13 is connected to the zero-crossing detector 4, the phase cut dimmer 5, the overpower protector 6, the input device 7, the infrared receiver circuit 9, the brightness indicator circuit 10, the minimum brightness setting device 11, and the leading edge phase cut/trailing edge phase cut selecting device 12.

The bridge rectifier 2 includes a rectifier pile or a diode; the LDO power circuit 3 includes an integrated LDO chip or a discrete component to achieve a LDO function; the zero-crossing detector 4 includes a high/low level or ADC detector; the phase cut dimmer 5 includes a MOS or an IGBT; the overpower protector 6 includes a high/low level or ADC detector; the input device 7 includes a button module or a touch module; the leading edge phase cut/trailing edge phase cut selecting device 12 includes a DIP switch or a potentiometer; the minimum brightness setting device 11 includes a rotary switch dial or a potentiometer; the brightness indicator circuit 10 includes a light emitting diode; the infrared receiver circuit 9 includes an infrared receiver module or a discrete circuit composed of the infrared receiver module; and the single chip microcomputer minimum system 13 detects an input or receives an infrared to perform a phase cut dimming.

The technical characteristics of this invention is described by an embodiment in conjunction with FIG. 1 as follows:

A TRIAC single-fire-wire power-taking infrared smart dimmer includes: a single-fire-wire input device 1; a bridge rectifier 2 for converting an input of AC into a square wave; a LDO power circuit 3 for stabilizing an output voltage; a zero-crossing detector 4 for distinguishing a frequency; a phase cut dimmer 5 for driving a MOS or IGBT tube; an overpower protector 6 for protecting the dimmer; an input device 7 for inputting an operation; a single-fire-wire output device 8; and an infrared receiver circuit 9 for smart dimming; a brightness indicator circuit 10 for indicating the current brightness percentage, a minimum brightness setting device 11; a leading edge phase cut/trailing edge phase cut selecting device 12; and a single chip microcomputer minimum system 13 for control and data processing.

The single-fire-wire input device 1 is connected to the LDO power circuit 3 through the bridge rectifier 2, and then connected to the zero-crossing detector 4 and the phase cut dimmer 5, and the phase cut dimmer 5 is connected to the single-fire-wire output device.

The LDO power circuit 3 is connected to the zero-crossing detector 4, the phase cut dimmer 5, the overpower protector 6, the input device 7, the infrared receiver circuit 9, the brightness indicator circuit 10, the minimum brightness setting device 11, the leading edge phase cut/trailing edge phase cut selecting device 12, and the single chip microcomputer minimum system 13. Specifically, the single-fire-wire input device 1 obtains the square wave, so that the LDO power circuit 3 has a stable voltage and supplies power to the overpower protector 6, input device 7, the infrared receiver circuit 9, the brightness indicator circuit 10, the minimum brightness setting device 11, the leading edge phase cut/trailing edge phase cut selecting device 12, and the single chip microcomputer minimum system 13.

The single chip microcomputer minimum system 13 is connected to the zero-crossing detector 4, the phase cut dimmer 5, the overpower protector 6, the input device 7, the infrared receiver circuit 9, the brightness indicator circuit 10, the minimum brightness setting device 11, and the leading edge phase cut/trailing edge phase cut selecting device 12.

The zero-crossing detector 4 uses the signal from the bridge rectifier 2 to distinguish the frequency and control the phase cut dimmer 5.

The phase cut dimmer 5 uses the smart control signal transmitting through the input device 7 or the infrared receiver circuit 9 to the single chip microcomputer minimum system 13 to control the phase cut dimmer 5.

The overpower protector 6 uses the single chip microcomputer minimum system 13 to control the phase cut dimmer 5. If there is an overload, the overpower protector will output a signal to the single chip microcomputer minimum system 13 to carry out necessary protections.

The input device 7 can use the brightness indicator circuit 10 to select a short press on the switch light to fine-tune the brightness or a long press on the switch light to rough-tune the brightness.

The infrared receiver circuit 9 can use the brightness indicator circuit 10 to select a short press on the switch light to provide the fine-tuned brightness or a long press on the switch light to provide the rough-tuned brightness.

The brightness indicator circuit 10 can display the current brightness percentage according to the current brightness value.

The minimum brightness setting device 11 sets an initial brightness value for the TRIAC single-fire-wire power-taking infrared smart dimmer.

The leading edge phase cut/trailing edge phase cut selecting device 12 is provided for the compatibility of various different power supplies.

When the input device 7 is operated to control the basic level of the single chip microcomputer minimum system 13 to achieve the effects of controlling the phase cut dimmer 5, while selecting a leading edge phase cutting or a trailing edge phase cutting by the leading edge phase cut/trailing edge phase cut selecting device 12, and displaying the current brightness value according to the current brightness value displayed by the brightness indicator circuit 10.

After the infrared receiver circuit 9 has received data, the basic layer of the smart control the single chip microcomputer minimum system 13 is provided for controlling the phase cut dimmer 5, while selecting a leading edge phase cutting or a trailing edge phase cutting by the leading edge phase cut/trailing edge phase cut selecting device 12, and displaying the current brightness value according to the current brightness value displayed by the brightness indicator circuit 10.

While the invention has been described by means of specific embodiments, numerous modifications and variations could be made thereto by those skilled in the art, without departing from the scope and spirit of the invention set forth in the claims.

What is claimed is:

1. A TRIAC single-fire-wire power-taking infrared smart dimmer, comprising: a single-fire-wire input device (1), a bridge rectifier (2), a LDO power circuit (3), a zero-crossing detector (4), a phase cut dimmer (5), an overpower protector (6), an input device (7), a single-fire-wire output device (8), an infrared receiver circuit (9), a brightness indicator circuit (10), a minimum brightness setting device (11), a leading edge phase cut/trailing edge phase cut selecting device (12), a single chip microcomputer minimum system (13), characterized in that the single-fire-wire input device (1) is coupled to the bridge rectifier (2); the bridge rectifier (2) is coupled to the LDO power circuit (3), the zero-crossing detector (4), and the phase cut dimmer (5); the LDO power circuit (3) is coupled to the overpower protector (6), the input device (7), the infrared receiver circuit (9), the brightness indicator circuit (10), the minimum brightness setting device (11), the leading edge phase cut/trailing edge phase cut selecting device (12), and the single chip microcomputer minimum system (13); the phase cut dimmer (5) is coupled to the single-fire-wire output device (8); and the single chip microcomputer minimum system (13) is coupled to the zero-crossing detector (4), the phase cut dimmer (5), the overpower protector (6), the input device (7), the infrared receiver circuit (9), the brightness indicator circuit (10), the minimum brightness setting device (11), and the leading edge phase cut/trailing edge phase cut selecting device (12).

2. The TRIAC single-fire-wire power-taking infrared smart dimmer according to claim 1, wherein the bridge rectifier (2) comprises a rectifier pile or a diode; the LDO power circuit (3) comprises an integrated LDO chip or a discrete component for implementing a LDO function; the zero-crossing detector (4) comprises a high/low level or ADC detector; the phase cut dimmer (5) comprises a MOS or an IGBT; the overpower protector (6) comprises a high/low level or ADC detector; the input device (7) comprises a button module or a touch module; the leading edge phase cut/trailing edge phase cut selecting device (12) comprises a DIP switch or a potentiometer; the minimum brightness setting device (11) comprises a rotary switch dial or a potentiometer; the brightness indicator circuit (10) comprises a light emitting diode; the infrared receiver circuit (9) comprises an infrared receiver module or a discrete circuit composed of the infrared receiver module; the single chip microcomputer minimum system (13) detects the input device or the infrared receiver to perform a phase cut dimming.

* * * * *